US006810684B2

(12) United States Patent
Lee et al.

(10) Patent No.: US 6,810,684 B2
(45) Date of Patent: Nov. 2, 2004

(54) AIR CONDITIONER

(75) Inventors: Won Hee Lee, Seoul (KR); Sim Won Jin, Seoul (KR); Cheol Soo Ko, Seoul (KR); In Wha Jung, Seoul (KR); Dong Soo Moon, Seoul (KR); Chul Oh Ahn, Seoul (KR); Moon Kee Chung, Seoul (KR); Sang Bum Sohn, Seoul (KR); In Chul Yoon, Seoul (KR); Kwan Shik Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/624,523

(22) Filed: Jul. 23, 2003

(65) Prior Publication Data

US 2004/0050088 A1 Mar. 18, 2004

Related U.S. Application Data

(62) Division of application No. 10/028,306, filed on Dec. 28, 2001, now Pat. No. 6,640,574.

(30) Foreign Application Priority Data

Dec. 28, 2000 (KR) ..... P2000-83907
Dec. 28, 2000 (KR) ..... P2000-83908

(51) Int. Cl.[7] ..... F28D 5/00
(52) U.S. Cl. ..... 62/305; 62/272; 62/280
(58) Field of Search ..... 62/272, 279, 280, 62/305

(56) References Cited

U.S. PATENT DOCUMENTS

| | | | | |
|---|---|---|---|---|
| 2,961,843 A | * | 11/1960 | McMillan et al. | 62/150 |
| 3,662,557 A | | 5/1972 | Morgan | |
| 3,872,684 A | * | 3/1975 | Scott | 62/181 |
| 4,248,057 A | | 2/1981 | Yaguchi | |
| 4,438,635 A | * | 3/1984 | McCoy, Jr. | 62/305 |
| 4,494,384 A | | 1/1985 | Lott | |
| 5,444,991 A | * | 8/1995 | Cox | 62/305 |
| 6,050,101 A | | 4/2000 | Liu | |

* cited by examiner

*Primary Examiner*—Melvin Jones
(74) *Attorney, Agent, or Firm*—Birch, Stewart, Kolasch & Birch, LLP

(57) ABSTRACT

Object of the present invention is to improve a structure of the air conditioner, to provide an air conditioner which can dispose of condensed water from an evaporator within the air conditioner itself without discharging to outside of the air conditioner, and improve an air conditioner efficiency.

To achieve the object of the present invention, the air conditioner of the present invention includes a condenser which generates a high temperature heat, an evaporator which absorbs an external heat, and forms condensed water on a surface thereof by a temperature difference with an external air, and condensed water self disposal means for transferring the condensed water on the surface of the condenser to a condenser side, and evaporating the condensed water from the surface of the condenser by the high temperature heat from the condenser, thereby disposing of the condensed water within the air conditioner itself.

18 Claims, 5 Drawing Sheets

AIR CONDITIONER

This application is a Divisional of application Ser. No. 10/028,306 filed Dec. 28, 2001, now U.S. Pat. No. 6,640, 574.

This application claims the benefit of the Korean Applications No. P2000-83907 filed on Dec. 28, 2000 and No. P2000-83908 filed on Dec. 28, 2000, which are hereby incorporated by reference.

BACKGROUND OF THE INVENTION

1. Field of the Invention

The present invention relates to an air conditioner which can dispose of condensed water from an evaporator within the air conditioner itself, and improve an air conditioner efficiency.

2. Background of the Related Art

Referring to FIG. 1, in general, the air conditioner is an apparatus provided with a compressor 1, a condenser 2, a capillary tube 3, and an evaporator 4, for forming a series of refrigerating cycle by subjecting refrigerant to compression at the compressor 1, to isobaric condensing at the condenser 2, to adiabatic expansion at the capillary tube 3, and to isobaric evaporation at the evaporator 4.

In the meantime, there is condensed water formed on a surface of the evaporator 4, for removal of which the air conditioner is provided with additional condensed water disposal device. Though not shown, the condensed water disposal device is, as known, provided with a separate condensed water storage chamber for collecting the condensed water formed at the evaporator 4 and discharge to outside of the air conditioner at fixed intervals.

However, the condensed water disposal device has the following problem.

Since the condensed water formed at the evaporator 4 is, not disposed of within the air conditioner itself, but drained to outside of the air conditioner, installation and use of the air conditioner have been complicated. That is, there has been a complicacy in installation of the air conditioner as a separate drain hose is required for guiding the condensed water formed at the evaporator 4, and a hole is punctured in a wall for passing the hose, and a complicacy in use as re-routing of the hose is required when the air conditioner is re-positioned.

SUMMARY OF THE INVENTION

Accordingly, the present invention is directed to an air conditioner that substantially obviates one or more of the problems due to limitations and disadvantages of the related art.

An object of the present invention is to provide an air conditioner which can dispose of condensed water from an evaporator within the air conditioner itself without discharging to outside of the air conditioner, and improve an air conditioner efficiency.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the air conditioner includes a condenser which generates a high temperature heat, an evaporator which absorbs an external heat, and forms condensed water on a surface thereof by a temperature difference with an external air, and condensed water self disposal means for transferring the condensed water on the surface of the condenser to a condenser side, and evaporating the condensed water from the surface of the condenser by the high temperature heat from the condenser, thereby disposing of the condensed water within the air conditioner itself.

The condensed water self disposal means may include a guide flow passage for guiding the condensed water formed at the evaporator to a condenser side, and a condensed water spraying unit provided on a side of the condenser for spraying the condensed water guided from the guide flow passage onto the surface of the condenser.

The condensed water self disposal means may require no additional device for transferring condensed water formed at the evaporator to the condenser, but to fit the evaporator over the condenser so that the condensed water falls down from the evaporator to a surface of the condenser by gravity, and evaporates, and disappears by the high temperature heat from the evaporator.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings.

Figure 1:
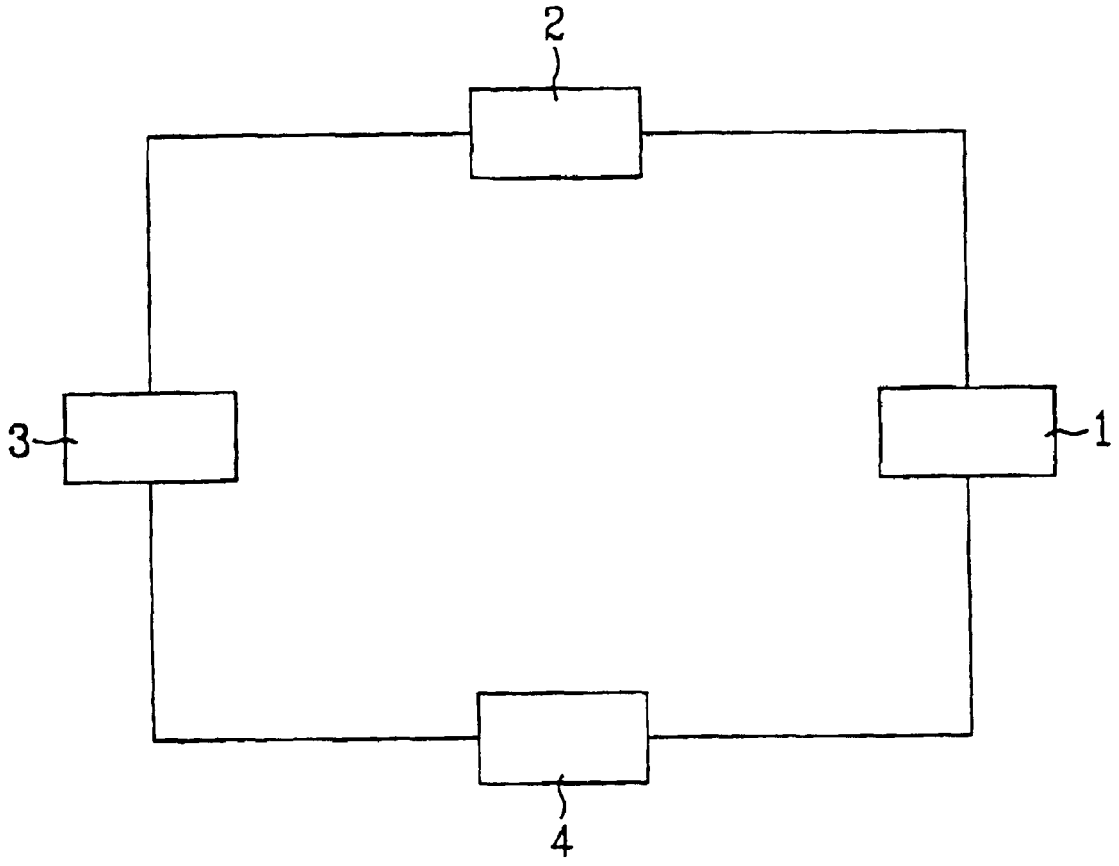
FIG.1 PRIOR ART
FIG. 1 illustrates a block diagram of a system of a related art air conditioner.
Figure 2:
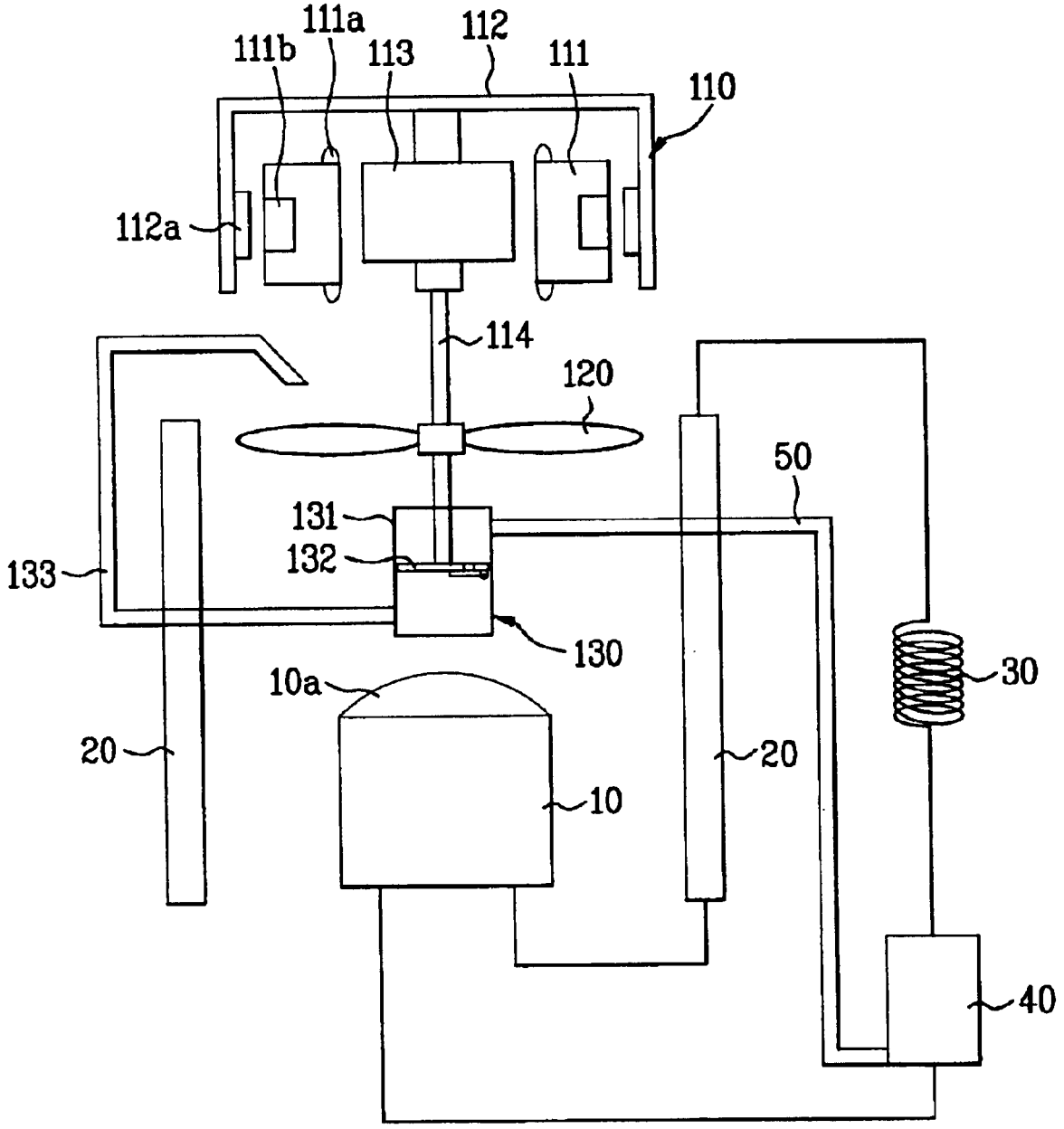
FIG. 2 illustrates a detail of key parts of an air conditioner in accordance with a first preferred embodiment of the present invention.
Figure 4:
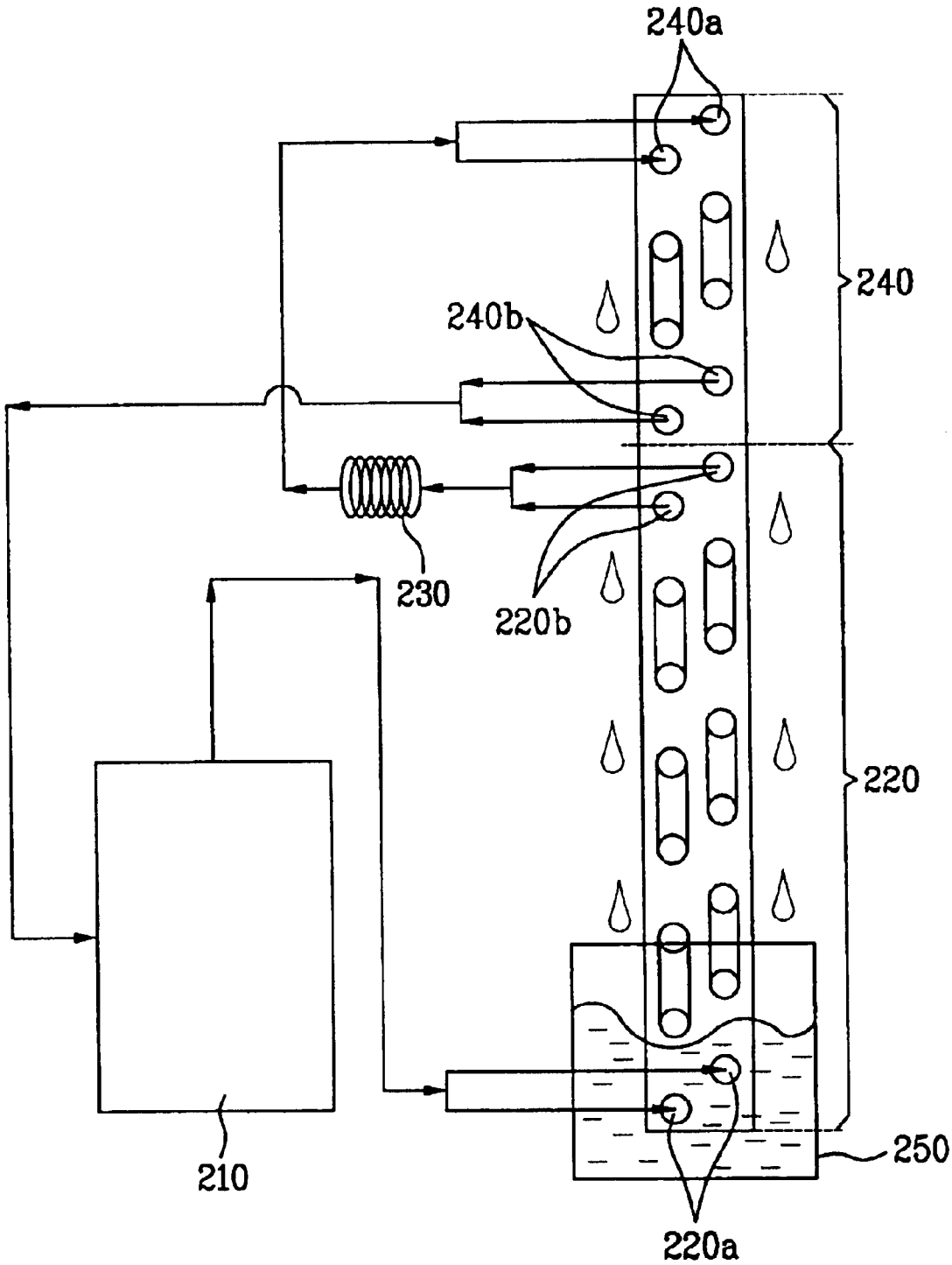

Referring to FIGS. 2 and 4, the air conditioner of the present invention includes a condenser 20 or 220 which generates a high temperature heat, an evaporator 40 or 240 which absorbs external heat and forms condensed water at a surface thereof due to a temperature difference with external air, and condensed water self disposal means for transferring the condensed water formed on the surface of the evaporator to the condenser to evaporate the condensed water at the surface of the condenser by the heat from the condenser, thereby disposing of the condensed water within the air conditioner itself.

The condensed water self disposal means in accordance with a first preferred embodiment of the present invention will be explained in detail, with reference to FIG. 2.

The condensed water self disposal means includes a guide flow passage 50 connected between the evaporator and the condenser for guiding the condensed water formed at the evaporator 40 to the condenser 20, and a condensed water spraying unit 100 for spraying the condensed water guided by the guide flow passage onto a surface of the condenser.

Preferably, the condensed water spraying unit 100 includes a motor 110 with two degree of freedom over the condenser having a motor shaft 114 for making rotating and linear movement, a heat dissipation fan 120 coupled with the motor shaft for rotating when the motor is in operation, and a pump part 130 at an end of the motor shaft for making a linear movement when the motor is in operation to draw the condensed water through the guide flow passage 50, and supplying the condensed water to an upper part of the heat dissipation fan 120.

First, the motor 110 with two degree of freedom in the condensed water spraying unit will be explained in detail.

Preferably, the motor 110 with two degree of freedom has a cylindrical stator 111, a linear motion member 112 movably fitted around the stator for making up/down movement relative to the stator 111, a rotor 113 positioned inside of the stator and rotatably supported on the linear motion member 112, and a motor shaft 114 extended from the rotor.

The stator 111 has rotating motion coil 111*a* wound adjacent to the rotor 113, and a linear motion coil 111*b* wound adjacent to the linear motion member 112, and the linear motion member 112 has a magnet 112*a* in correspondence to the linear motion coil 111*b*.

Accordingly, upon application of a power, the rotor 113 and the motor shaft 114 are rotated by an electromotive force between the rotor 113 and the rotating motion coil 111*a*, and the linear motion member 112 and the motor shaft 114 make linear reciprocating motion by an electromotive force between the magnet 112*a* and the linear motion coil 111*b*.

Second, the heat dissipation fan 120 in the condensed water spraying unit is preferably arranged over the compressor 10, and the condenser 20 is preferably bent around the heat dissipation fan 120 and the compressor 10, for precise spraying, evaporation, and disposal of the condensed water supplied to the heat dissipation fan 120 toward the condenser 20 and the compressor 10. It is preferable that a water proof cover 10*a* is provided on the compressor 10 for preventing infiltration of the condensed water into electric fitting part above the compressor 10.

Third, the pump part 130 in the condensed water spraying unit includes a hollow body 131 connected to the guide flow passage 50 for receiving the condensed water, and having a hole for movably inserting an end of the motor shaft 114, a piston 132 at one end of the motor shaft 114 for making a linear motion with the motor shaft when the motor is in operation for drawing the condensed water from the guide flow passage, and pressing the condensed water in the hollow body 131, and a supply tube 133 for supplying the condensed water to an upper part of the heat dissipation fan 120 by a pressing force of the piston.

The piston 132 preferably has a through hole (see 132*a* in FIG. 3A) for passing the condensed water, and a closing member (see 132*b* in FIG. 3A) for opening/closing the through hole to form a pumping force according to an up/down direction of motion of the piston.

The closing member 132*b* may be hinged at a bottom of the piston 132 so that the closing member 132*b* opens the through hole 132*a* when the piston 132 moves upward, and closes the through hole when the piston moves downward. In this instance, preferably the guide flow passage 50 is connected to the body 131 at a position higher than a top dead center of the piston 132, and the supply tube 133 is connected to the body 131 at a position lower than a bottom dead center of the piston 132.

Though not shown, the closing member may be hinged at an upper surface of the piston 132 so that the closing member 132*b* closes the through hole 132*a* when the piston 132 moves upward, and opens the through hole when the piston moves downward. In this instance, preferably the guide flow passage is connected to the body 131 at a position lower than the bottom dead center of the piston 132, and the supply tube 133 is connected to the body 131 at a position higher than the top dead center of the piston 132. The unexplained reference symbol 30 denotes the capillary tube for expanding the refrigerant.

The operation of the air conditioner in accordance with a first preferred embodiment of the present invention will be explained with reference to FIGS. 3A and 3B.

The condensed water formed on the surface of the evaporator 40 by a temperature difference with exterior is introduced into the body 131 in the pump part through the guide flow passage 50. As explained the piston 132 in the pump part makes linear reciprocating movement by the motor 110 with two degree of freedom.

Figure 3A:
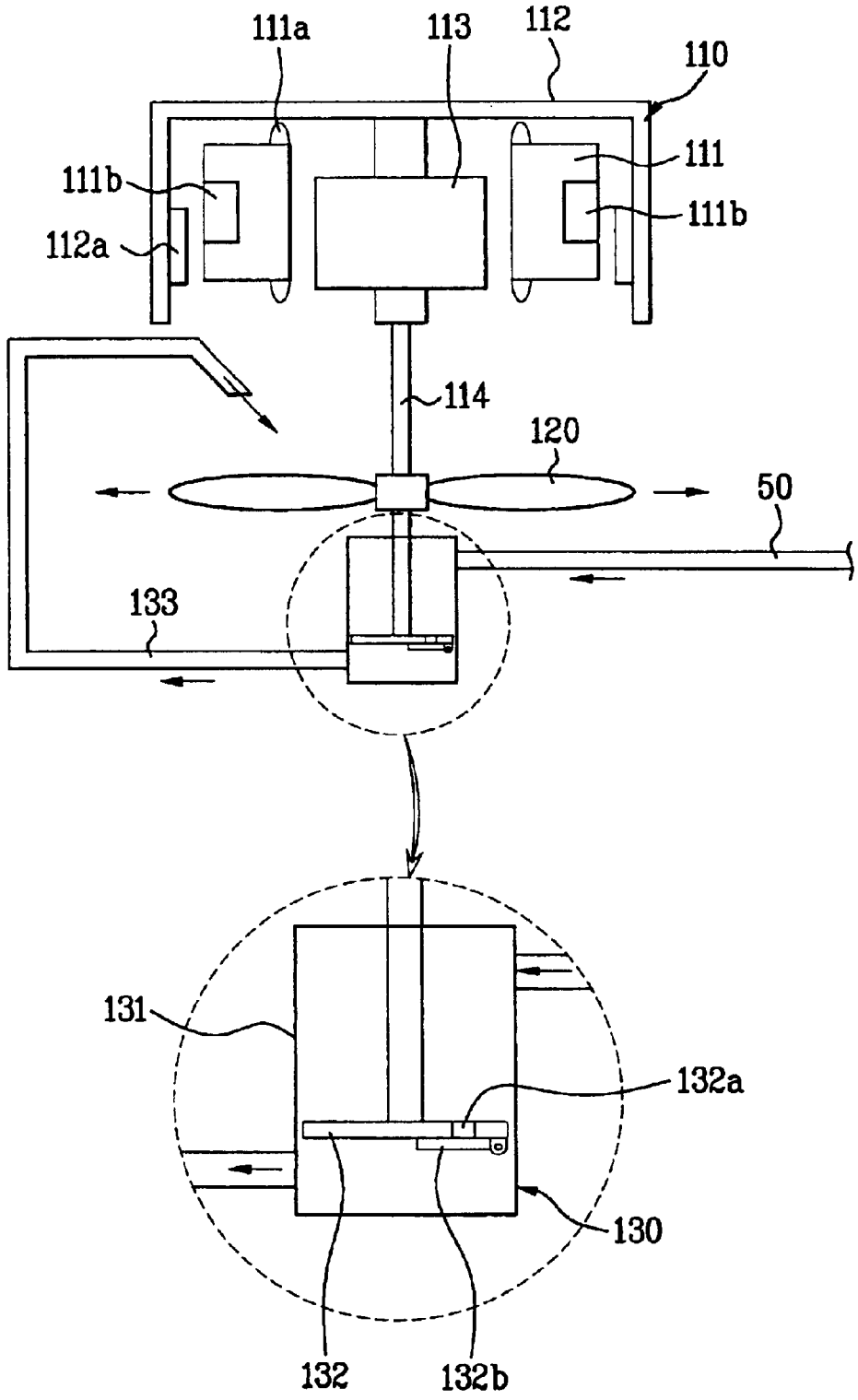
FIGS. 3A and 3B illustrate details of key parts each showing an operation state of the condensed water spraying means in FIG. 2; and, FIG. 4 illustrates a detail of key parts of an air conditioner in accordance with a second preferred embodiment of the present invention.

That is, as shown in FIG. 3A, when the piston 132 moves down, the closing member 132*b* closes the through hole 132*a* by inertia, such that the piston 132 pushes out the condensed water to the supply tube 133 as the piston 132 moves down until the bottom dead center.

Figure 3B:
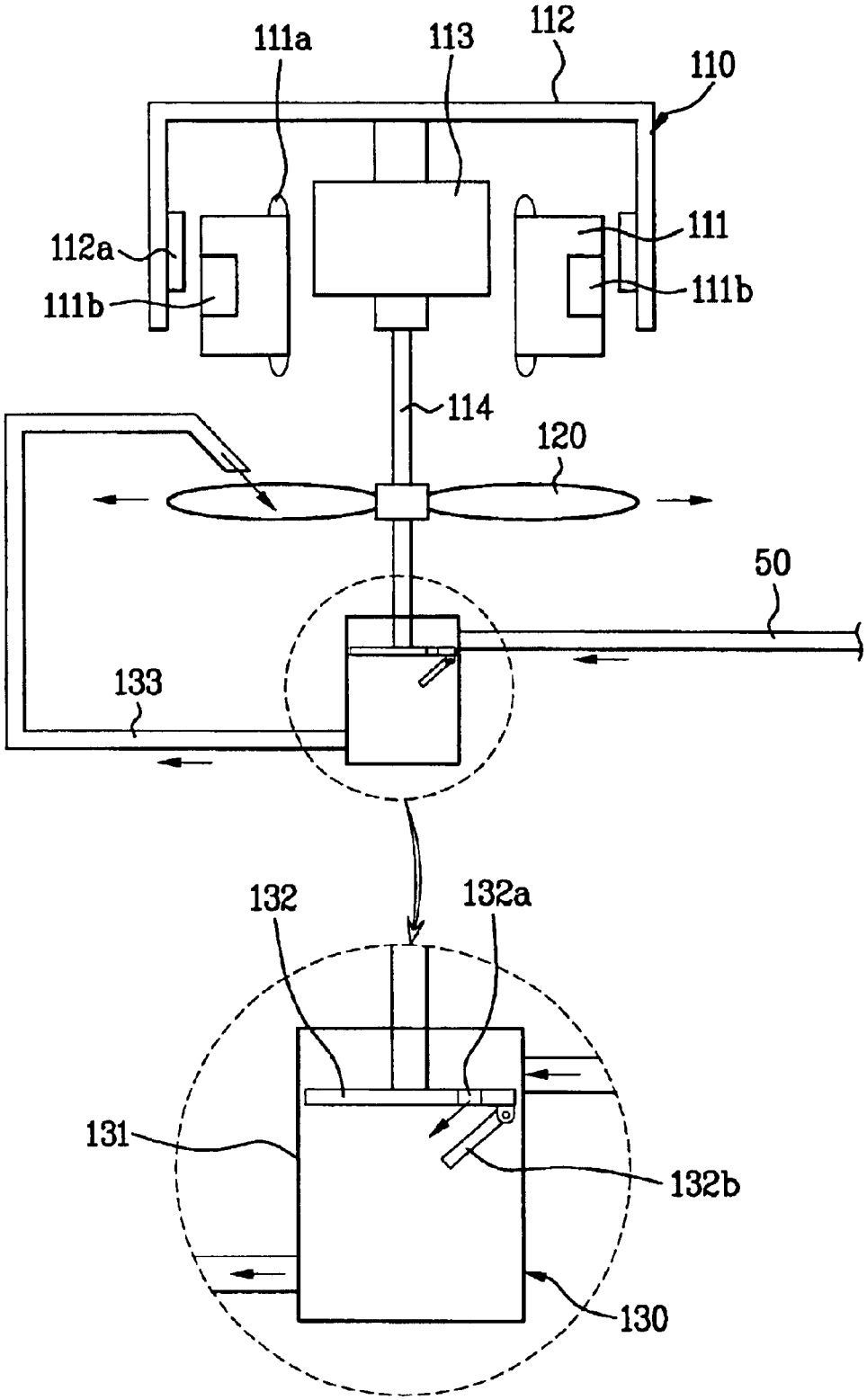

Referring to FIG. 3B, when the piston 132 moves up, the through hole 132*a* is opened by gravity of the closing member 132*b* and the introduced condensed water, such that the condensed water in the upper part of the body 131 flows down to a lower part of the body 131 through the through hole 132*a*.

Accordingly, even if the condenser 20 is fitted at a position higher than the evaporator 40, the condensed water formed at the evaporator can be lead toward the condenser.

Then, as the piston makes linear movement, the condensed water is supplied to an outer circumference of the heat dissipation fan 120 through the supply tube 133, and sprayed in a radial direction of the heat dissipation fan as the heat dissipation fan is rotated by the motor 110 with two degree of freedom which also rotates. In this instance, the condensed water turned into minute droplets by the blades of the heat dissipation fan 120, and sprayed onto a surface of the condenser 20 bent to surround the compressor 10 and the heat dissipation fan 120. At the end, while the condensed water evaporates, and disappears as the condensed water is crashed onto the surface of the condenser 20, the condenser is cooled down by the condensed water, thereby improving a refrigerating efficiency, an air conditioner efficiency. Moreover, when the condenser is fitted in a room, the evaporated water provides an appropriate humidity to the room, to make the room comfortable.

When some of the condensed water drops down to the compressor 10 during the condensed water is sprayed, the condensed water flows down along the water proof cover 10*a* on the surface of the compressor 10. Eventually, while the condensed water is evaporated, and disappears from the surface of the compressor which is at a comparatively high temperature (80~100° C.), the refrigerating efficiency, an air conditioner efficiency, is improved as the compressor is cooled down by the condensed water. Moreover, when the condenser is fitted in a room, the evaporated water provides an appropriate humidity to the room, to make the room comfortable.

A condensed water self disposal means in accordance with a second preferred embodiment of the present invention will be explained, with reference to FIG. 4.

The condensed water self disposal means in accordance with a second preferred embodiment of the present invention requires no additional device for transferring condensed water formed at the evaporator 240 to the condenser 220, but to fit the evaporator 240 over the condenser 220 so that the condensed water falls down from the evaporator to a surface of the condenser by gravity, and evaporates, and disappears by the high temperature heat from the evaporator.

In this instance, a lower part of the evaporator 240 may be arranged adjacent to an upper part of the condenser 220, or the lower part of the evaporator 240 may be formed as one unit with the upper part of the condenser 220. When the evaporator 240 and the condenser 220 are fabricated as one unit, structure and fabrication of the evaporator 240 and the condenser 220 become very simple, and the condensed water from the evaporator 240 can flow down to the condenser 220 directly, and evaporated and disappears by the high temperature heat from the condenser.

Preferably, for reducing a possible heat loss between the evaporator 240 and the condenser 220, a refrigerant outlet 220*b* at the condenser 220, of which temperature is relatively lower than the refrigerant inlet 220*a*, is positioned on an evaporator 240 side rather than the refrigerant inlet 220*a* at the condenser 220, as a refrigerant outlet temperature is 40~50° C. while a refrigerant inlet temperature is 60~80° C. Accordingly, the refrigerating efficiency, the air conditioner efficiency, is improved, and more condensed water is formed at the surface of the evaporator as a temperature difference of the evaporator 240 with exterior becomes greater, which makes the room comfortable as evaporated condensed water provides adequate humidity in the room.

In order to reduce a possible heat loss between the condenser 220 and the evaporator 240, preferably a refrigerant outlet 240*b* at the evaporator 240, of which temperature is relatively higher than the refrigerant inlet 240*a* at the evaporator 240, is positioned on a condenser 220 side rather than the refrigerant inlet 240*a* at the evaporator 240, as a refrigerant outlet temperature of the evaporator is 10~15° C. while a refrigerant inlet temperature is 8~10° C. Accordingly, alike above case, the refrigerating efficiency, the air conditioner efficiency, is improved, and more condensed water is formed at the surface of the evaporator as a temperature difference of the evaporator 240 with exterior becomes greater, which makes the room comfortable as evaporated condensed water provides adequate humidity in the room.

In summary, for doubling the air conditioner efficiency and comfort by efficient reduction of the possible heat loss between the condenser 220 and the evaporator 240, preferably, the refrigerant outlet 220*b* at the condenser and the refrigerant outlet 240*b* at the evaporator are formed adjacently.

Along with this, as a countermeasure for a case when the condensed water from the surface of the evaporator 240 is not evaporated completely from the condenser 220, a condensed water receiver 250 may be provided at a lowest part of the condenser 220 for receiving a small amount of condensed water that is not evaporated yet, when a refrigerant inlet 220*a* side of the condenser 220 is preferably placed below a level of the condensed water collected in the condensed water receiver 250, for cooling down the condenser 220 and evaporating the condensed water by the high temperature heat from the condenser. The unexplained reference symbol 210 denotes a compressor for compressing the refrigerant, and the reference symbol 230 denotes the capillary tube for expanding the refrigerant.

The operation of the air conditioner of the present invention will be explained in detail, with reference to FIG. 4.

As the high temperature refrigerant compressed at the compressor 210 is introduced into the condenser a part of which is submerged in the condenser through the refrigerant inlet 220*a* at the condenser, the condenser 220 is cooled down by the condensed water, and the condensed water is evaporated by the high temperature heat from the condenser. The refrigerant introduced through the refrigerant inlet 220*a* at the condenser is involved in gradual temperature drop until the refrigerant flows out through the refrigerant outlet 220*b* at the condenser, and flows into the capillary tube 230.

The refrigerant, involved in temperature cool down at the capillary tube 230 and introduced into the evaporator 240, is involved in temperature rise as the cooled refrigerant makes heat exchange with flowing air until flows out through the refrigerant outlet 240*b* at the evaporator, when the condensed water formed at the evaporator 240 flows down to the high temperature condenser 220 below the evaporator 240 by gravity where the condensed water is evaporated, or collected in the condensed water receiver 250, if there is a small amount of the condensed water not evaporated yet, and made to evaporate completely by the high temperature heat at the refrigerant inlet 220*a* side of the condenser.

The refrigerant flows out of the refrigerant outlet 220*b* at the condenser, and is introduced into the compressor 210 again, thereby repeat the cycling.

It will be apparent to those skilled in the art that various modifications and variations can be made in the air conditioner of the present invention without departing from the spirit or scope of the invention. Thus, it is intended that the present invention cover the modifications and variations of this invention provided they come within the scope of the appended claims and their equivalents.

The air conditioner of the present invention has the following advantages.

First, the condensed water formed at the evaporator can be evaporated within the air conditioner itself, requiring no drain hose lead to outside of a room, no puncture in a wall, thereby making installation simple, and an outer appearance good.

Second, the cooling down of the condenser by the condensed water formed at the evaporator can reduce a work of the compressor, that improves an air conditioning efficiency.

Third, when the condenser, or the compressor is in the room, the adequate humidity from the evaporated condensed water makes the room feel comfortable.

All the advantages of the present invention described in the specification are inclusive.

What is claimed is:

1. An air conditioner comprising:

a condenser capable of rejecting high temperature heat from a refrigerant within said air conditioner to an external heat sink;

an evaporator which absorbs an external heat from a heat source, wherein said heat source includes external air, and condensed water from said external air is capable of being formed on a surface of said evaporator by a temperature difference with the external air; and, a condensed water self disposal device for transferring the condensed water on the surface of the evaporator to an external surface of the condenser, and evaporating the condensed water from the surface of the condenser by the high temperature heat from the condenser, thereby disposing of the condensed water within the air conditioner itself, wherein the condensed water self disposal device includes a guide flow passage for guiding the condensed water formed at the evaporator to the external surface of the condenser, and a condensed water spraying unit provided for spraying the condensed water guided from the guide flow passage onto the external surface of the condenser, wherein the condensed water spraying unit includes a motor with two degrees of freedom over the condenser having a shaft for making rotating and linear movement, a heat dissipation fan coupled with the motor shaft for rotating when the motor is in operation, and a pump part provided at an end of the motor shaft for introducing the condensed water into the guide flow passage, and supplying the condensed water to an upper part of the heat dissipation fan, by the linear movement of the motor shaft when the motor is in operation.

2. An air conditioner as claimed in claim 1, wherein the pump part includes;

a hollow body connected to the guide flow passage for receiving the condensed water, and having a hole for movably inserting an end of the motor shaft, a piston at one end of the motor shaft for making a linear motion with the motor shaft when the motor is in operation for drawing the condensed water from the guide flow passage, and pressing the condensed water in the hollow body, and a supply tube connected to the body for supplying the condensed water to an upper part of the heat dissipation fan by a pressing force of the piston.

3. An air conditioner as claimed in claim 2, wherein the piston includes:

a through hole for passing the condensed water, and a closing member for opening/closing the through hole to generate a pumping force in a up/down movement direction of the piston.

4. An air conditioner as claimed in claim 3, wherein the closing member is hinged on a bottom surface of the piston for opening the through hole when the piston moves upward, and closing the through hole when the piston moves downward.

5. An air conditioner as claimed in claim 4, wherein the guide flow passage is connected to the body at a position above a top dead center of the piston, and the supply tube is connected to the body at a position below a bottom dead center of the piston.

6. An air conditioner as claimed in claim 3, wherein the closing member is hinged on an upper surface of the piston for closing the through hole when the piston moves upward, and opening the through hole when the piston moves downward.

7. An air conditioner as claimed in claim 6, wherein the guide flow passage is connected to the body at a position below the bottom dead center of the piston, and the supply tube is connected to the body at a position above a top dead center of the piston.

8. An air conditioner as claimed in claim 1, wherein the heat dissipation fan is arranged over the compressor, and the condenser is bent around the heat dissipation fan and the compressor.

9. An air conditioner as claimed in claim 8, further comprising a water proof cover on the compressor for preventing infiltration of water into electric fittings above the compressor.

10. An air conditioner comprising:

a condenser capable of rejecting high temperature heat from a refrigerant within said air conditioner to an external heat sink;

an evaporator which absorbs an external heat from a heat source, wherein said heat source includes external air, and condensed water from said external air is capable of being formed on a surface of said evaporator by a temperature difference with the external air; and, a condensed water self disposal device for transferring the condensed water on the surface of the evaporator to an external surface of the condenser, and evaporating the condensed water from the surface of the condenser by the high temperature heat from the condenser, thereby disposing of the condensed water within the air conditioner itself, wherein the condensed water self disposal device includes a condensed water spraying unit provided for spraying the condensed water onto the external surface of the condenser, wherein the condensed water spraying unit includes a motor being positioned over the condenser and having a shaft, a heat dissipation fan coupled with the motor shaft for rotating when the motor is in operation, and a pump part connected to the motor shaft for introducing the condensed water into the guide flow passage, and supplying the condensed water to an upper part of the heat dissipation fan.

11. An air conditioner as claimed in claim 10, wherein the pump part includes;

a hollow body for receiving the condensed water, and having a hole for movably inserting an end of the motor shaft, a piston at one end of the motor shaft for making a linear motion with the motor shaft when the motor is in operation for drawing the condensed water, and pressing the condensed water in the hollow body, and a supply tube connected to the body for supplying the condensed water to an upper part of the heat dissipation fan by a pressing force of the piston.

12. An air conditioner as claimed in claim 11, wherein the piston includes:

a through hole for passing the condensed water, and a closing member for opening/closing the through hole to generate a pumping force in a up/down movement direction of the piston.

13. An air conditioner as claimed in claim 12, wherein the closing member is hinged on a bottom surface of the piston for opening the through hole when the piston moves upward, and closing the through hole when the piston moves downward.

14. An air conditioner as claimed in claim 13, wherein the the supply tube is connected to the body at a position below a bottom dead center of the piston.

15. An air conditioner as claimed in claim 12, wherein the closing member is hinged on an upper surface of the piston for closing the through hole when the piston moves upward, and opening the through hole when the piston moves downward.

16. An air conditioner as claimed in claim 15, wherein the supply tube is connected to the body at a position above a top dead center of the piston.

17. An air conditioner as claimed in claim 10, wherein the heat dissipation fan is arranged over the compressor, and the condenser is bent around the heat dissipation fan and the compressor.

18. An air conditioner as claimed in claim 17, further comprising a water proof cover on the compressor for preventing infiltration of water into electric fittings above the compressor.

* * * * *